United States Patent [19]

Ross

[11] 4,235,179

[45] Nov. 25, 1980

[54] UNDERBED THREAD TRIMMER PICKING ARM

[75] Inventor: Roger J. Ross, Mont St-Gregoire, Canada

[73] Assignee: The Singer Company, Stamford, Conn.

[21] Appl. No.: 58,871

[22] Filed: Jul. 19, 1979

[51] Int. Cl.[3] ..... D05B 3/00; D05B 65/02

[52] U.S. Cl. ..... 112/286; 112/292; 112/298

[58] Field of Search ..... 112/286, 292, 298, 300

[56] References Cited

U.S. PATENT DOCUMENTS

| | | | |
|---|---|---|---|
| 3,211,117 | 10/1965 | Speichermann et al. | 112/292 |
| 3,424,117 | 1/1969 | Schopf . | |
| 3,624,735 | 11/1971 | Hedegaard . | |
| 3,658,021 | 4/1972 | Hedegaard et al. . | |
| 3,776,161 | 12/1973 | Papajewski et al. . | |
| 3,867,892 | 2/1975 | Ciecion et al. . | |
| 3,894,502 | 7/1975 | Hager et al. | 112/298 X |

FOREIGN PATENT DOCUMENTS 1968920 7/1967 Fed. Rep. of Germany .

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A picking arm for an underbed thread trimmer which engages the bobbin thread and one limb of the needle thread and holds them so that a thread catching arm may engage the bobbin and needle threads and draw them into severing relation with a cutting edge of a thread cutting blade. After the threads have been cut, the picking arm returns to a rest position with the end of the bobbin thread retained in a channel contained in its thread engaging extremity. The bobbin thread is held in a position where it will be available for concatenation with a needle thread for the production of lockstitches.

2 Claims, 6 Drawing Figures

UNDERBED THREAD TRIMMER PICKING ARM

DESCRIPTION

BACKGROUND OF THE INVENTION

1. Field of the Invention

This invention relates to underbed thread trimmers for sewing machines which have picking arms for grasping the bobbin thread and holding it so that a proper stitch may be formed after the completion of the thread cutting cycle.

2. Description of the Prior Art

Sewing machine underbed thread trimmers are known which have picking arms which are driven across the face of the looptaker to engage and manipulate the needle thread during the thread cutting cycle. See for example the U.S. Pat. No. 3,776,161 which issued to Papajewski et al, on Dec. 4, 1973, the rights to which are assigned to the assignee of this invention and the teachings of which are incorporated herein by reference.

One problem with some formerly disclosed underbed thread trimmers is that the picking arm did not positively engage the bobbin thread and restrain it after the thread had been severed to facilitate the subsequent formation of lockstitches.

Another problem is that the thread engaging extremity of the picking arm was not designed to encourage the capture of one limb of the needle thread and the bobbin thread.

SUMMARY OF THE INVENTION

It is an object of this invention to provide a thread picking arm for an underbed thread trimmer which will positively engage one limb of the needle thread and the bobbin thread.

It is also an object of this invention to provide a thread picking arm which will restrain the bobbin thread and draw it backwardly across the face of the looptaker to place it in proper position preparatory to the commencement of the formation of lockstitches.

The above objects and other advantages are achieved by a pivotal thread picking arm which includes an outwardly extending beak at the thread engaging extremity thereof. The thread engaging beak engages and deflects one limb of needle thread and the bobbin thread into a serpentine channel carried in the picking arm which has an inwardly pointing hook contained therein which restrains the threads in a wedge shaped slot. The threads are thereby urged to remain with the picking arm as it is withdrawn across the face of the looptaker to its rest position, the restrained bobbin thread thereafter being in a location where it may be concatenated with a loop of needle thread during a subsequent initiation of the lockstitch formation cycle.

BRIEF DESCRIPTION OF THE DRAWINGS

The above and other objects of this invention will be evident from an understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
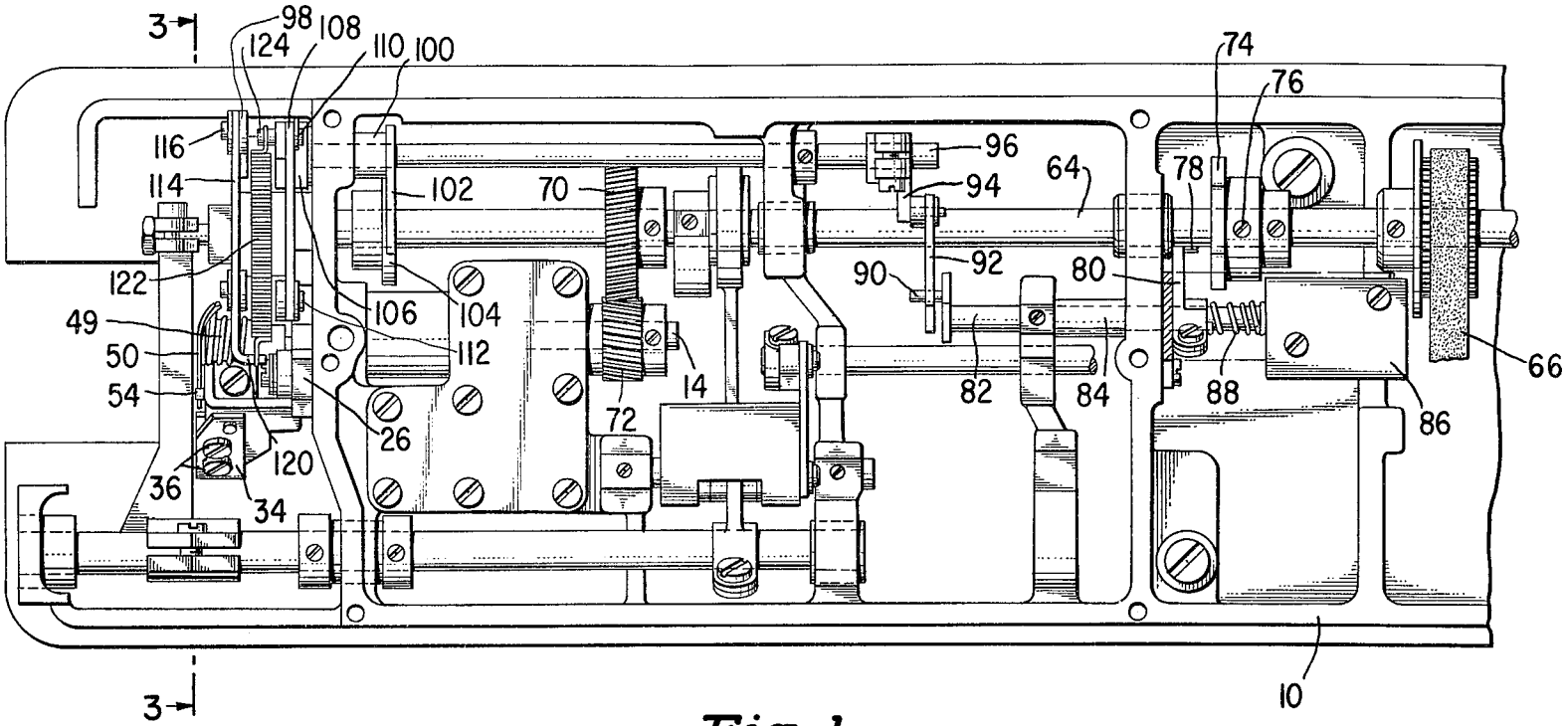
FIG. 1 is a bottom plan view of a lockstitch sewing machine having the teachings of this invention applied thereto.

Referring to the drawings, FIG. 1 shows a work supporting bed 10 of a sewing machine frame. A circularly moving looptaker, shown generally in FIG. 3 at 12, is supported on a horizontal hook shaft 14 within the bed 10 and serves to concatenate needle thread carried by a needle 16 with thread supplied from a bobbin 18 which is held in a bobbin case 20 within the looptaker 12 during the formation of lockstitches. The looptaker 12 includes a needle thread seizing beak 22 which may extend from a rim 24 of a cup-shaped body within which the bobbin case 20 is constrained. The looptaker body rim 24 includes a peripheral thread pull-off rib 26 which is attached to the hook body rim 24 in a manner which is well known in the art.

The thread trimmer picking arm disclosed herein is of a design suited to cooperate with a thread trimming mechanism such as that disclosed in the aforementioned U.S. Pat. No. 3,776,161 to Papajewski et al. Preferably the aforementioned thread trimmer mechanism includes a supporting block 15 which is fastened to the bed 10, to which the movable thread trimmer members may be pivotally fastened. A pair of bell crank levers 28 and 30 are pivotally fastened to the block 26 on a common fulcrum stud 32. A thread cutting blade 34 is secured to the bell crank lever 28 with a set of screws 36.

A thread catching arm 38, which is secured to one arm of the bell crank lever 30 by a fastening screw 40, is formed with a flattened heel portion 42 which overlaps and may engage a portion of the bell crank 28. The free extremity of the thread cutting blade 34 has a sharpened cutting edge 44, and the free extremity of the thread catching arm 38 is formed with a laterally extending thread engaging hook (not shown) suitable for catching and drawing threads across the cutting edge 44.

Figure 3:
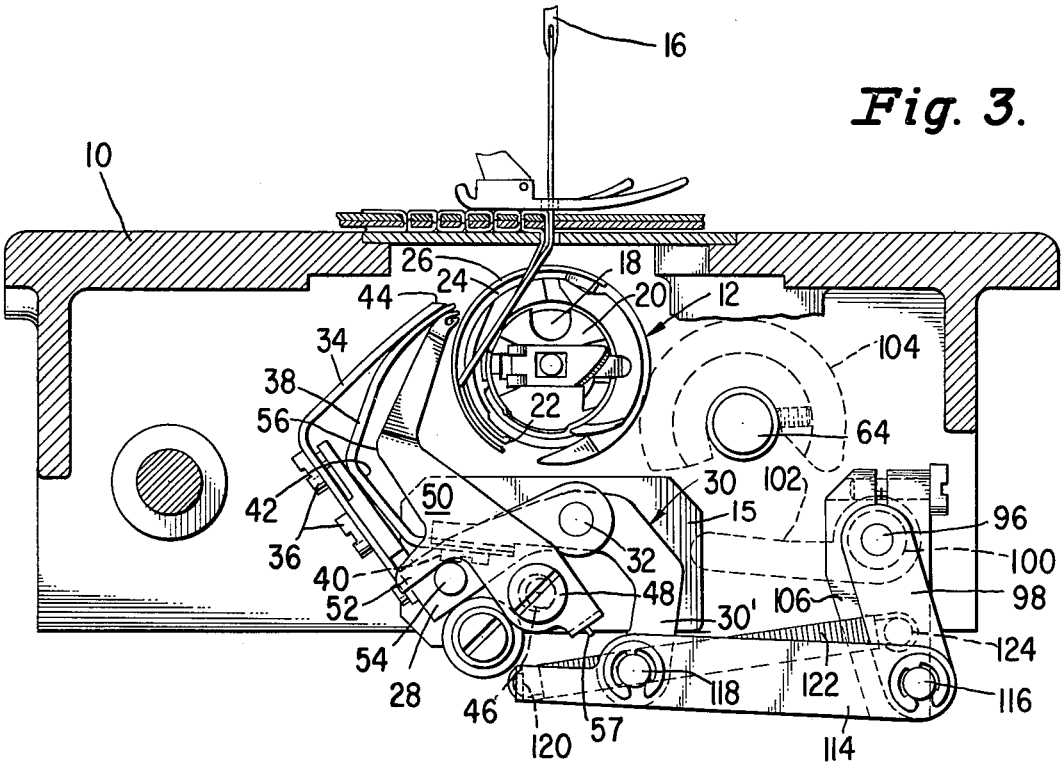
FIG. 3 is a cross-sectional view of the sewing machine bed taken substantially along line 3—3 of FIG. 1 showing the inoperative position of the thread trimmer elements.

In the retracted position of the thread cutting blade 34 such as is shown in FIG. 3, the sharpened edge 44 thereof and the thread engaging hook of the thread catching arm 38 occupy positions radially outwardly of the looptaker 12.

At a point spaced from the fulcrum stud 32, the support block 26 accommodates an eccentric end portion 46 of a pivot pin 48. The pin 48 pivotally carries a thread trimmer picking arm 50 which is shown in greater detail in FIG. 2. The picking arm is formed with a lateral stop arm 52 engageable with an abutment pin 54 projecting from the bell crank lever 28. The picking arm 50 is also formed with a shoulder 56 which is engageable with the flattened heel 42 of the thread catching arm 38. The pivot pin 48 has a coil spring 49 wound thereabout with one extremity anchored to the support block 26, and is formed at the other extremity 57 for engagement with the picking arm 50 so as to bias the picking arm 50 in a counterclockwise direction as viewed in FIGS. 3, 4, and 5 against either the abutment pin 54 or the heel 42 of the thread catching arm 38, whichever is shifted most in a clockwise direction.

Figure 2:
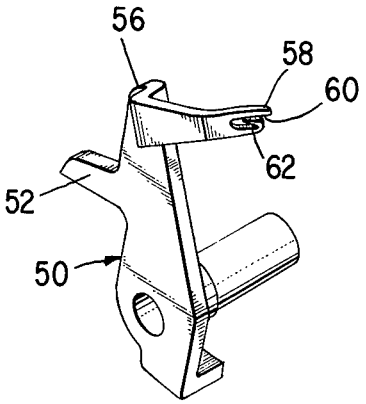
FIG. 2 is a perspective view of the picking arm.

FIG. 2 best illustrates that the picking arm has an outwardly extending beak 58 to deflect thread toward a channel 60 in which is located an inwardly pointed hook 62 which traps thread within the channel 60 and restrains it therein during retraction of the picking arm 50. In the most retracted position of the parts illustrated in FIG. 3, the outwardly extending beak 58 is located radially outward of the looptaker 12.

The hook of the thread catching arm 38 and the lateral beak 58 of the picking arm 50, to unerringly engage the sewing threads, move preferably in paths overlapping the paths of axial projections of elements on the looptaker 12. The actuating mechanism for shifting the elements of the thread trimming mechanism in such a way that interference with the looptaker is avoided, is disclosed in detail in the aforementioned U.S. patent to Papajewski et al and will be briefly described herein.

FIG. 1 best shows that the actuating mechanism includes a shaft 64 journalled in the bed 10, which is connected as by a timing belt 66 to other actuating mechanisms in the sewing machine. The hook shaft 14 is secured to the looptaker 12, and is driven by a pair of gears 70 and 72 from the shaft 64.

The bed shaft 64 carries two cam elements for operating the thread trimming mechanism. A first cam 74 is fastened to the shaft 64 with a set screw 76. The cam 74 includes a cam surface and cam lobes (not shown) which are disposed at different radial distances from the bed shaft axis. The cam 74 is engaged by a follower 78 which is formed at the extremity of a rock arm 80 which is rigidly fastened to a rock shaft 82 which is axially shiftable as well as rotatable in a bearing 84 carried in the bed 10. The rock shaft 82 is fastened to an electrically operable solenoid 86 which, when energized, draws the follower 78 into contact with the cam lobes on the cam 74. A return spring 88 urges the follower into a retracted position after the cam follower has become disengaged from the face of the cam 74.

An elongated crank pin 90 on the rock shaft 82 provides a connection with a link 92 which will not separate on axial movement of the rock shaft 82. The link 92 is pivotally fastened to a rock arm 94 which is rigidly secured to a rock shaft 96 which extends toward the looptaker 12. The opposite extremity of the rock shaft 96 has a rock arm 98 securely fastened thereto.

The rock shaft 96 extends through a rock sleeve 100 which is journalled in a web of the bed 10. A follower arm 102 for a cam 104 is secured to one extremity of the rock sleeve 100 and a rock arm 106 is secured to the rock sleeve 100 adjacent to the rock arm 98.

A connecting link 108 is provided between a pivot pin 110 in the rock arm 106 and a second pivot pin 112 in the lever arm 28' of the bell crank 28 to which the thread cutting blade 34 is secured.

A connecting link 114 is also provided between a pivot pin 116 in the rock arm 98 and a pivot pin 118 in the lever arm 30' of the bell crank 30 to which the thread catching arm 38 is secured. The link 114 has a bent extremity 120 to which is secured a spring 122 whose other extremity is fastened to a pin 124 located on the rock arm 106 between the sleeve 100 and the pivot pin 110. The spring 122 biases the parts of the thread trimming mechanism into a retracted position as shown in FIG. 3, so that the thread engaging elements are positioned radially outwardly of the looptaker, and the follower 78 is urged toward the axis of the bed shaft 64, and the follower arm 102 for the cam 104 is urged away from the axis of the bed shaft and into a retracted position away from the path of the lobe of the cam 104.

As is more particularly described in the aforementioned 3,776,161 patent to Papajewski et al, the cam 74 and the cam 104 drive the thread trimmer elements in arcuate paths which cross the face of the looptaker 12 to engage the needle and bobbin threads and draw them into engagement with the cutting edge 44 of the thread cutting blade 34.

Figure 4:
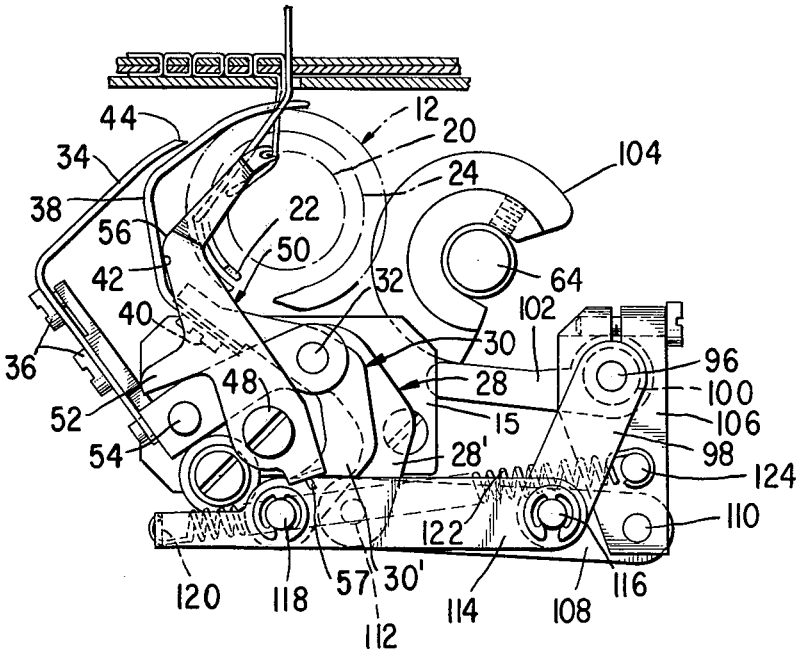
FIG. 4 is a cross-sectional view of the thread trimmer mechanism similar to FIG. 3 showing the thread catching arm advanced to snare the needle and bobbin threads and the picking arm holding the bobbin thread and about to engage a limb of needle thread.

FIG. 4 illustrates the first movement of the thread catching arm 38 and the picking arm 50 in response to rotation of the bed shaft 64 after the solenoid 86 has drawn the follower arm 102 into engagement with the cam 104 and the follower 78 into engagement with the cam 74. The thread catching arm 38 has been carried inwardly across the path of the looptaker pull-off rib carrying with it the outwardly extending beak 58 of the picking arm 50.

Figure 5:
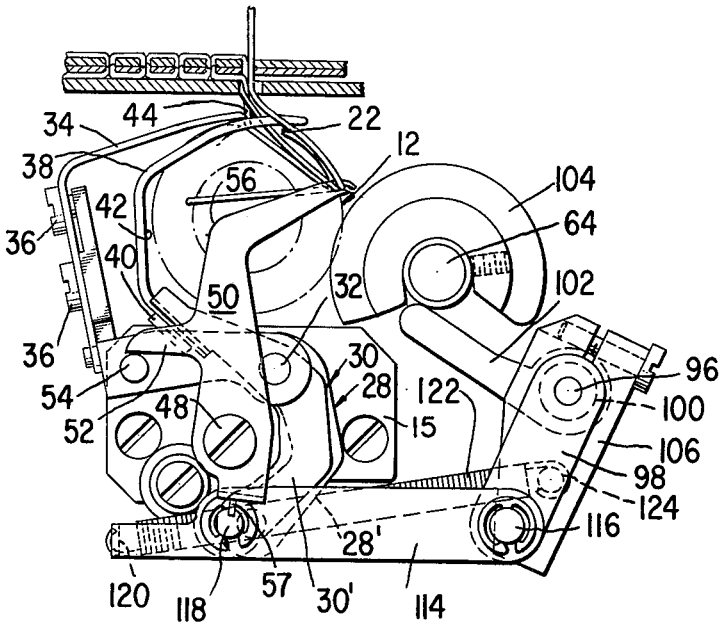
FIG. 5 is a view similar to FIG. 4 showing the picking arm in its maximum extended position.

Continued rotation of the shaft 64 will cause the thread cutting blade 34 to move into cutting position as is shown in FIG. 5. The picking arm 50 will be moved outwardly so that one limb of the needle thread and the bobbin thread are trapped in the channel 60 of the picking arm 50.

During this time, the cam 74 will cause an additional movement of the thread catching arm 38 to insure pick-up of both the bobbin and needle thread limbs to be severed.

Figure 6:
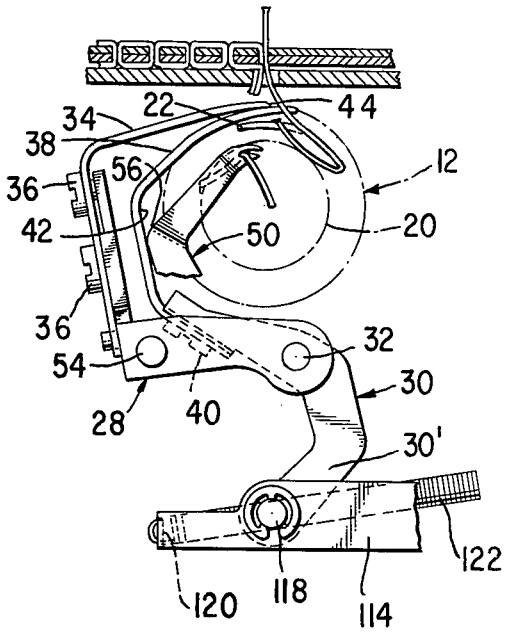
FIG. 6 is a view similar to FIG. 5 showing the bobbin and needle threads severed and also showing a tail of the bobbin thread being restrained by the picking arm.

As is best shown in FIG. 6, further rotation of the bed shaft 64 will cause the thread catching arm 38 to retract into thread severing relation with the thread cutting blade 44. The thread cutting blade 44 will sever one limb of needle thread and the bobbin thread which were retained by the thread catching arm 38.

After the cam 74 moves out of engagement with the follower 78, the thread trimmer components will return to the rest positions shown in FIG. 3. The picking arm 50 will draw with it one limb of the needle thread and the bobbin thread which are retained in the channel 60 by the hook 62. After the removal of the work garment being sewn, the bobbin thread alone will be retained by the picking arm 50 so that upon the first penetration of the fabric by the needle, the bobbin thread will be in a proper location for concatenation with a needle thread for the formation of a lockstitch.

What has been described herein is a novel thread picking arm for use with an underbed thread trimmer which engages one limb of needle thread and the bobbin thread and retains the bobbin thread upon the completion of the thread cutting cycle to ensure the accurate initiation of a subsequent sewing cycle. It will be appreciated that modifications and variations of the above described invention may become evident to one skilled in the art in light of the above teachings. However, it is to be understood that the present disclosure relates to but one preferred embodiment which is for the purpose of illustration only, and should not be construed as a limitation on the scope of the invention. All modifications which do not depart from the invention are intended to be included within the scope of the appended claims.

I claim:

1. In a sewing machine including a circularly moving looptaker having a face, said looptaker concatenating a needle thread with a bobbin thread from a bobbin contained within said looptaker, a thread trimming mechanism comprising a plurality of thread influencing members each separately supported for movement transversely across the face of said looptaker, means operatively connected to said sewing machine for selectively moving said thread influencing members across the face of said looptaker in response to the rotation of said looptaker, said thread influencing members comprising a thread cutting blade for severing said bobbin thread and a limb of said needle thread, a thread catching arm for engaging a limb of needle thread and said bobbin thread, said thread catching arm drawing said bobbin and said needle threads into severing relation with said thread cutting blade, and a thread picking arm including means thereon for engaging said bobbin thread and a limb of said needle thread for retaining said bobbin thread and drawing it backwardly across the face of said looptaker after said bobbin thread and a limb of said needle threads have been severed.

2. An underbed thread trimmer as set forth in claim 1 wherein said picking arm comprises an elongated arm having a first extremity and a second extremity, said first extremity of said elongated arm pivotally fastened to said sewing machine bed to permit arcuate pivotal motion of said second extremity of said arm across the face of said looptaker, said second extremity of said arm including the engaging means of a thread engaging beak extending outwardly from said second extremity and toward the face of said looptaker, a thread accommodating channel formed in said second extremity of said arm, said thread engaging beak deflecting thread into said channel, and a said retaining means including a hook within said channel to trap thread entering said channel, whereby said picking arm engages a bobbin thread and a limb of needle thread when arcuately driven across the face of said looptaker and restrains said bobbin thread therein when drawn backwardly across the face of said looptaker.

* * * * *